US007536132B2

(12) United States Patent
Minagawa

(10) Patent No.: US 7,536,132 B2
(45) Date of Patent: May 19, 2009

(54) DEVELOPING RECOVERY CONTAINER

(75) Inventor: Hironori Minagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/865,509

(22) Filed: Oct. 1, 2007

(65) Prior Publication Data

US 2008/0031654 A1 Feb. 7, 2008

Related U.S. Application Data

(62) Division of application No. 10/329,393, filed on Dec. 27, 2002, now abandoned.

(30) Foreign Application Priority Data

Dec. 28, 2001 (JP) ..... 2001-401824

(51) Int. Cl.
*G03G 15/04* (2006.01)
*G03G 15/08* (2006.01)
*G03G 15/01* (2006.01)

(52) U.S. Cl. ..... 399/119; 399/120; 399/227

(58) Field of Classification Search ..... 399/120, 399/227, 119

See application file for complete search history.

(56) References Cited

U.S. PATENT DOCUMENTS 5,508,794 A 4/1996 Ikesue et al. ..... 355/260
5,752,141 A 5/1998 Nishimura et al. ..... 399/227

FOREIGN PATENT DOCUMENTS

| | | |
|---|---|---|
| JP | 06-308829 | 11/1994 |
| JP | 09-218575 | 8/1997 |
| JP | 09-288375 | 11/1997 |
| JP | 10-198144 | 7/1998 |

OTHER PUBLICATIONS

Patent Abstracts of Japan, vol. 2000, No. 6 for JP 2000-089571A, Sep. 2000.
Patent Abstracts of Japan, vol. 018, No. 657 (P-1842) for JP06-258943, Dec. 1994.

*Primary Examiner*—David M Gray
*Assistant Examiner*—Erika Villaluna
(74) *Attorney, Agent, or Firm*—Fitzpatrick, Cella, Harper & Scinto

(57) ABSTRACT

A developer collecting container detachably mountable to a rotatable member which is provided in an image forming apparatus to rotate a developing device, the developer collecting container which is rotatable while being substantially fixed to the rotatable member with the developing device, the developer collecting container includes a receiving port for receiving a developer discharged from the developing device; an accommodating portion for accommodating the developer collected from the developing device; a guiding pipe, having a discharge opening for permitting discharging of the developer into the accommodating portion, for guiding the developer receiver at the receiving port with rotation of the rotatable member to the discharge opening, wherein the discharge opening is disposed adjacent a center of gravity of the developer collecting container.

9 Claims, 7 Drawing Sheets

DEVELOPING RECOVERY CONTAINER

FIELD OF THE INVENTION AND RELATED ART

The present invention relates to a developer recovery container employed by an image forming apparatus which forms an image with the use of an electrophotographic or electrostatic recording method.

Usually, a developer container filled with developer is mounted in an image forming apparatus employing, for example, an electrophotographic recording method. A developer container is disposed in a manner to oppose an electrophotographic photoconductive member (photoconductive member) as an image bearing member, and an image is formed by visualizing an electrostatic latent image with the toner container in the developer.

In a color image forming apparatus, a plurality of developer containers different in the color of the developers contained therein are mounted. For example, when an image forming apparatus having only one image bearing member is used to form a color image, a color image is formed in the following manner. A plurality of electrostatic latent images in accordance with a plurality of sets of image formation data correspondent, one for one, to the color components of an intended image, are sequentially formed on the image bearing member, and each electrostatic latent image is developed by supplying the electrostatic latent image with the developer corresponding in color to the electrostatic latent image from one of the plurality of developer containers. Some image forming apparatuses, in particular, color image forming apparatuses, do not require toner to contain a magnetic substance. Therefore, it is quite common that such image forming apparatuses use the so-called two-component developer, that is, developer, the main components of which are nonmagnetic resinous toner particles (toner) and magnetic carrier particles (carrier).

In an image forming apparatus which uses a two-component developer, the carrier gradually deteriorates as the image forming process is repeated. The deterioration of the carrier results in the formation of images with lower quality. Thus, in order to prevent the formation of lower quality images, it is necessary to recover the deteriorated carrier, and add a fresh supply of carrier to the developer from which the deteriorated carrier is recovered. Further, it is mandatory that when recovering the deteriorated carrier, the deteriorated carrier is prevented from flowing backward.

There have been proposed various methods for recovering deteriorated carrier, and various methods for preventing deteriorated carrier from flowing backward. As for the recovery method, there is the deteriorated developer recovery method disclosed in Japanese Laid-open Patent Application 6-308829, according to which a developer container is fitted with a replaceable developer supply cartridge, and the supply and recovery of developer are accomplished by replacing the replaceable developer supply cartridge. As for the method for recovering developer, the developer having overflowed from a developer container is recovered with the use of a plurality of screws.

Japanese Laid-open Patent Application 9-218575 discloses technologies regarding the recovery method and backflow prevention method. According to these technologies, the rotational developer recovery container is provided with an internal helical partitioning wall, which prevents the backward movement of the developer in the developer recovery container as the container is rotated. Further, Japanese Laid-open Patent Application 10-198144 discloses a structure for preventing the backflow. According to this structure, the developer recovery container is provided with a valve, which is disposed in the developer recovery port.

The above described methods and structural arrangements, however, suffer from the following problems.

First, in the case of the developer recovery method disclosed in the Japanese Laid-open Patent Application 6-308829, there need be no worry that the waste carrier will flow backward. However, the provision of the plurality of screws for conveying waste carrier makes the apparatus itself large and complicated, increasing the cost of the main assembly of an image forming apparatus.

In the case of the developer recovery method disclosed in the Japanese Laid-open Patent Application 9-218575, the developer recovery path is complicated, more specifically, it is helical. Thus, it takes a full rotation of the developer rotary for the developer to drop inward. Therefore, this recovery method is inferior in terms of developer recovery efficiency. Also in this case, the recovery container is complicated in structure, being therefore costlier to mold. Further, the complex structure of the recovery container makes it easier for waste carrier to stagnate in the waste carrier recovery passage, raising the possibility that the waste carrier will flow backward.

Further, in the case of the developer recovery method and developer backflow prevention method disclosed in Japanese Laid-open Patent Application 10-198144, the provision of the backflow prevention valve makes the developer recovery container complicated in structure, which in turn makes the developer recovery container difficult to assemble, and also, difficult to mold, increasing the container cost.

SUMMARY OF THE INVENTION

The primary object of the present invention is to provide a developer recovery container capable of preventing developer from flowing backward.

Another object of the present invention is to provide a developer recovery container superior in developer storage efficiency to a developer recovery container in accordance with the prior arts.

Another object of the present invention is to provide a developer recovery container superior in developer recovery efficiency to a developer recovery container in accordance with the prior art.

Another object of the present invention is to provide a developer recovery container which is more compact than a developer recovery container in accordance with the prior art.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, developer recovery containers in accordance with the present invention will be described in detail with reference to the appended drawings.

Embodiment 1

Figure 10:
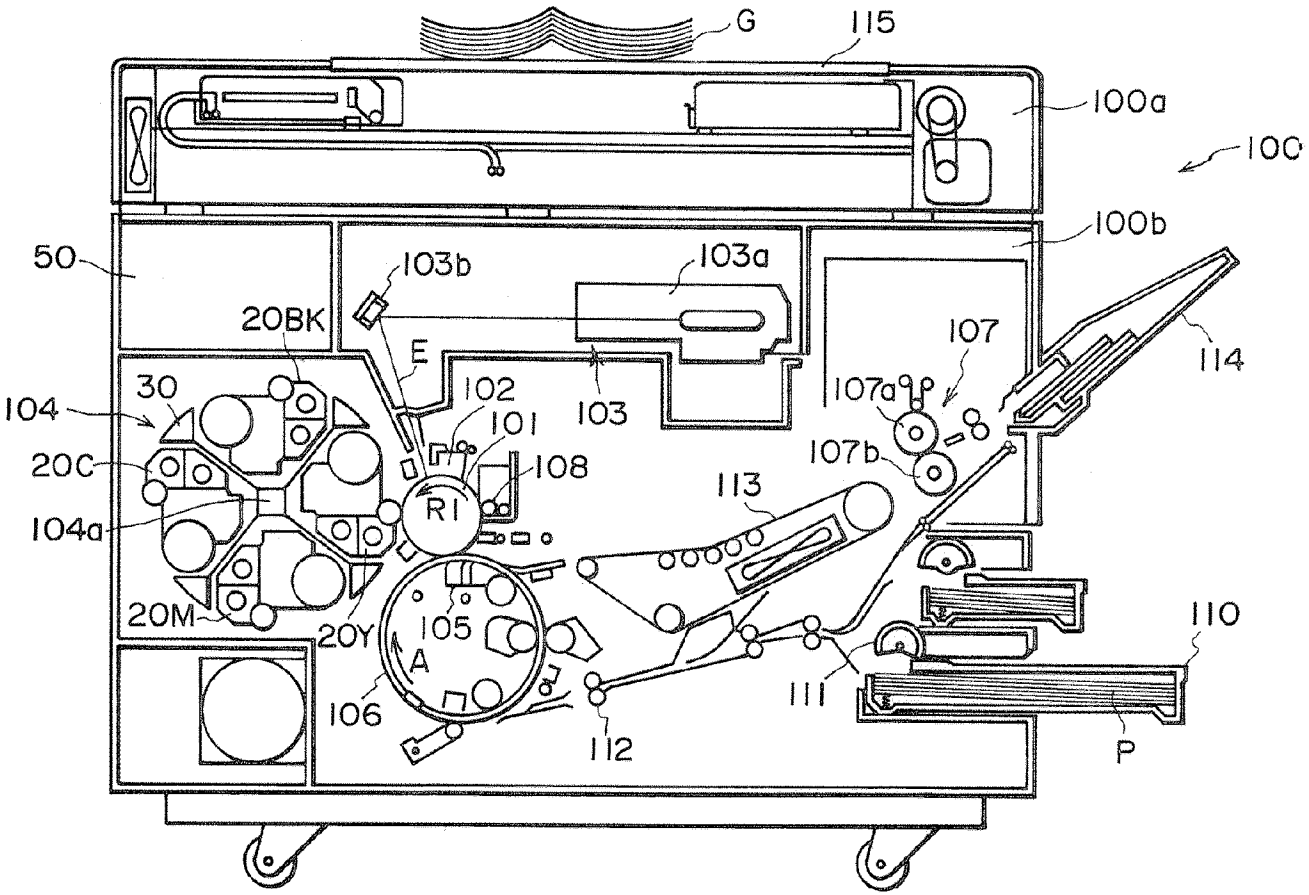
FIG. 10 is a schematic sectional view of an example of an image forming apparatus to which the present invention is applicable.

FIG. 10 is a schematic sectional view of an example of an image forming apparatus to which the present invention is applicable. In this embodiment, the present invention is embodied in the form of an electrophotographic color copying machine capable of forming a full-color image with the use of an electrophotographic image forming method. However, it should be understood that the application of the present invention is not limited to an electrophotographic color copying machine. An electrophotographic image forming apparatus which forms an image on recording medium with the use of an electrophotographic image forming method, and to which the present invention is applicable, includes an electrophotographic copying machine, an electrophotographic printer (for example, laser beam printer, LED printer, etc.), a facsimileing apparatus, a word processor, etc.

First, an image forming apparatus 100 will be described in general structure and operation. The image forming apparatus 100 can be roughly divided into an original reading portion 100*a* and an image forming portion 100*b*. The original reading portion 100*a* reads an original G placed on an original placement platen 115, with the use of the well-known technology. More specifically, the original G on the original placement platen 115 is illuminated in a scanning manner, and the light reflected by the original G is focused on a CCD, which converts the light into image formation data in the form of electrical signals and sends the data to the image forming portion 100*b*.

Based on the thus obtained image formation data, the image forming portion 100*b* forms an image on a recording medium P, for example, a piece of recording paper, a OHP sheets, etc., with the use of an electrophotographic image forming method. Further, the image forming apparatus 100 is also capable of forming an image on the recording medium P, based on the image formation signals sent from an external host apparatus (unshown) connected to the image forming apparatus main assembly 50 (which hereinafter may be referred to simply as apparatus main assembly) so that the two sides can communicate with each other; in other words, the image forming apparatus 100 is capable of functioning as the so-called printer.

The image forming portion 100*b* has a photoconductive drum 101, that is, an electrophotographic photoconductive member, as an image bearing member, in the form of a drum. The photoconductive drum 101 is rotated in the direction indicated by an arrow mark R1 in the drawing, with its peripheral surface kept in contact with a transfer drum 107 as a recording medium bearing member. In the adjacencies of the peripheral surface of the photoconductive drum 101, a primary charging device 102 as a charging means for uniformly charging the photoconductive drum 101, an optical system 103 for forming an electrostatic latent image on the peripheral surface of the photoconductive drum 101, a rotary developing apparatus 104 as a developing means for developing the electrostatic latent image formed on the peripheral surface of the photoconductive drum 101, a cleaning means 108, etc., are disposed. The optical system 103 has an exposing means 103*a* such as a laser beam scanner, an exposure light deflecting means 103*b*, etc.

The rotary developing apparatus 104 has a rotary 30, which constitutes a frame (developing apparatus holding member) for supporting developing devices. The rotary 30 is rotatable about the shaft 104*a*, and is disposed in a manner to oppose the peripheral surface of the photoconductive drum 101. In the rotary 30, four developing devices 20 are mounted, being evenly distributed in terms of the rotational direction of the rotary 30 in order to visualize (develop) an electrostatic latent image formed on the peripheral surface of the photoconductive drum 101. In this embodiment, the four developing devices mounted in the rotary 30 are developing devices 20Y, 20M, 20C, and 20Bk for developing electrostatic latent images corresponding to yellow, magenta, cyan, and black color components, respectively.

These four developing devices 20Y-20Bk are sequentially moved to a location (location occupied by yellow developing device 20Y in FIG. 1), at which they visualize (develop) corresponding electrostatic latent images.

As an image forming operation begins, the peripheral surface of the photoconductive drum 101, which is rotating in the arrow R1 direction in the drawing, is uniformly charged by the primary charging device 102. The charged peripheral surface of the photoconductive drum 101 is exposed to a beam of laser light E projected from the optical system 103 in a manner to scan the peripheral surface of the photoconductive drum 101 while being modulated with the image formation data corresponding to the first color component. As a result, an electrostatic latent image corresponding to the first color component is formed on the peripheral surface of the photoconductive drum 101. This electrostatic latent image is visualized as an image formed of developer (toner image) by the developing device corresponding to the first color component, among the developing devices 20Y-20Bk of the rotary developing apparatus 104.

Meanwhile, a plurality of recording medium P stored in a cassette 110 as a recording medium storing portion are sequentially fed into the apparatus main assembly 50 by a separation roller 111. Each recording medium P is released by a registration roller 112 in synchronism with the toner image formation on the photoconductive drum 101, is delivered to a transfer drum 106 as a recording medium bearing member, is adhered to the transfer drum 106, and is conveyed to the transfer station, where the peripheral surface of the photoconductive drum 101 opposes a transferring means 105 disposed within the transfer drum 106. In the transfer station, the toner image corresponding to the first color component formed on the photoconductive drum 101 is electrostatically transferred onto the recording medium P on the transfer drum 106 due to the function of the transferring means 105.

Then, toner images corresponding to the second to fourth color components are sequentially formed on the photoconductive drum 101 through processes identical to the process carried out to form the toner image corresponding to the first color component, and are sequentially transferred in layers onto the recording medium P while the recording medium P is kept on the transfer drum 106 and is repeatedly conveyed through the transfer station.

After the transfer of the toner image corresponding to the fourth color component, the recording medium P is separated from the transfer drum 106, and is conveyed to a fixing apparatus 107 by a conveying means 113. In the fixing apparatus 107, the recording medium P is conveyed between a fixing roller 107*a* containing a heating means, and a pressure roller 107*b* disposed in contact with the fixing roller 107*a*, by being nipped by the two rollers 107*a* and 107*b*. While the recording medium P is conveyed through the fixing apparatus 107, the unfixed toner images on the recording medium P are fixed to the recording medium P by heat and pressure. Thereafter, the recording medium P is discharged into a delivery tray 114 located outside the apparatus main assembly 50.

After the completion of the transfer of the toner images different in color, the peripheral surface of the photoconductive drum 101 is cleaned by a cleaning means 108; the toner particles remaining on the peripheral surface of the photoconductive drum 101 are removed by the cleaning means 108. Then, the cleaned portion of the peripheral surface of the photoconductive drum 101 is used again for image formation.

Next, referring to FIG. 1, the developing devices 20Y-20Bk will be described. In this embodiment, the developing devices 20Y-20Bk are identical in structure, although they are different in the color of the developer they use. Thus, hereinafter, unless otherwise noted, the characters Y, M, C, and Bk suffixed to the referential numeral 20 to differentiate the developing devices in the color of the developer they contain, will be omitted.

Figure 1:
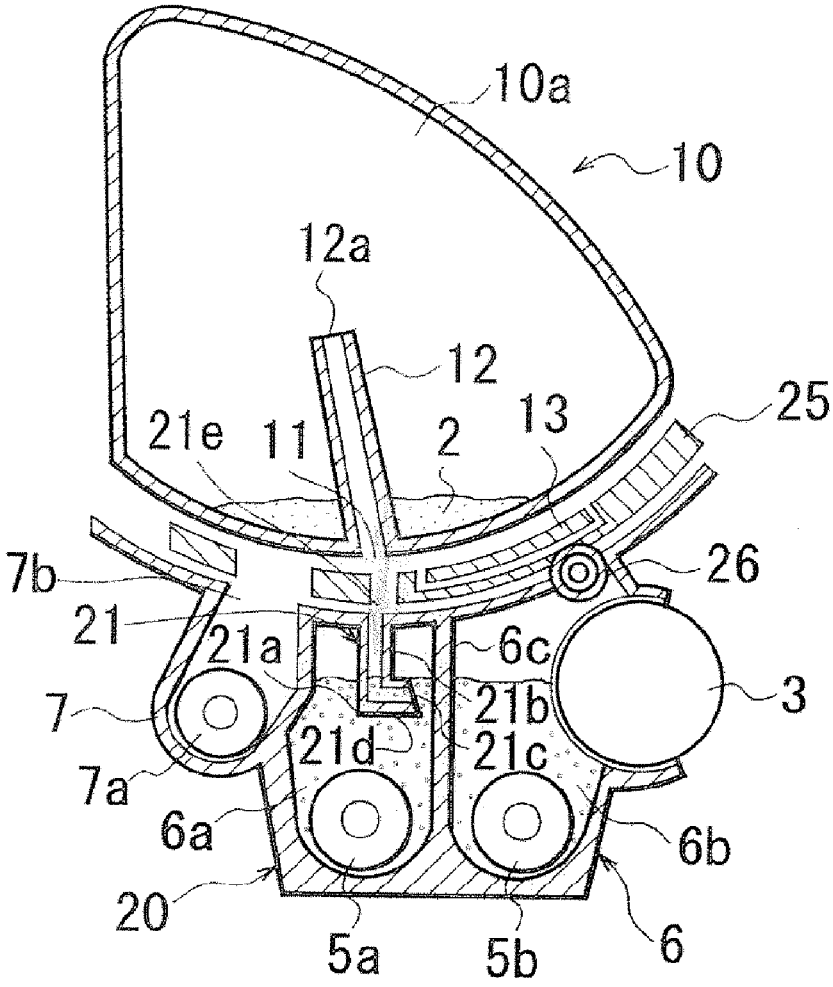
FIG. 1 is a schematic sectional view of a combination of an embodiment of a developer recovery container in accordance with the present invention, and a developing device.

FIG. 1 is a schematic sectional view of a combination of the developing device 20 and developer recovery container 10 (which will be described later) in this embodiment. In this embodiment, the developing device 20 holds two-component developer, the essential components of which are nonmagnetic resin toner in particle form, and nonmagnetic carrier in particle form, and which is stored in the developing means container 6 of the developing device. The internal space of the developing means container 6 is approximately halved into a stirring chamber 6*a* and a development chamber 6*b*, by a partitioning wall 6*c*. The partitioning wall 6*c* extends in the direction perpendicular to FIG. 1, but is not in contact with the front and rear end walls of the developing means container 6 in terms of the direction perpendicular to FIG. 1, allowing the developer to move between the stirring chamber 6*a* and development chamber 6*b*. The developing device also comprises a pair of developer stirring/conveying members 5*a* and 5*b*, which are disposed in the stirring chamber 6*a* and development chamber 6*b*, respectively, and which are different in the direction in which they convey the developer. The developer in the developing means container 6 is circularly conveyed, while being stirred, in the developing means container 6 by the developer stirring/conveying members 5*a* and 5*b*. In this embodiment, the developer stirring/conveying members 5*a* and 5*b* are in the form of a screw.

The developing means container 6 has an opening, which extends in the lengthwise direction of the developer container. A development roller 3 as a developer bearing member is rotationally disposed, virtually blocking this opening of the developing means container 6. The development roller 3 contains a magnetic roll as a magnetic field generating means. The carrier in the development chamber 6*a* is adhered to the peripheral surface of the development roller 3 by the magnetic force of the magnetic roll. During development, the development roller 3 rotates, bearing on its peripheral surface, a magnetic brush made up of carrier particles and toner particles electrostatically adhering to carrier particles, and conveys the developer to the area, in which the development roller 3 opposes the photoconductive drum 101, and in which the development roller 3 supplies the toner particles to the photoconductive drum 101 in accordance with the electrostatic latent image formed on the photoconductive drum 101. The carrier particles which remained on the development roller 3 after the development are recovered into the developing means container 6 by the rotation of the development roller 3, and are made to join the body of developer being circulated in the developing means container 6.

The particulate carrier employed as one of the primary components of two-component developer deteriorates as its cumulative usage increases; for example, toner particles permanently adhere to the surfaces of the carrier particles, and/or the external additive particles having separated from toner particles adhere to the surfaces of the carrier particles, reducing toner particles in static electricity capacity, and therefore, allowing toner particles to scatter. Thus, the carrier is desired to be replaced at optimal intervals.

In order to make easier the operation for recovering the developer, which has deteriorated as described above, in particular, the deteriorated carrier (which hereinafter will be referred to simply as waste carrier), a fresh supply of two-component developer inclusive of both toner and carrier is gradually supplied to the developing device. As the fresh supply of developer is supplied to the developing device, the excessive amount of the two-component developer, inclusive of the waste carrier, is automatically and gradually discharged from the developing device, and is recovered into the developer recovery container.

The developer recovery container is removably attached to the rotary developing apparatus 104. It is structured so that it rotates with the rotary without changing its positional relationship to the corresponding developing device. Further, the developer recovery container and developing device are structured so that while the rotary is rotating, it is virtually impossible for them to rotate about their own rotational axes. With the provision of this structural arrangement, as the rotary rotates, the developer recovery container and developing device are made to orbit about the rotational axis 104*a* of the rotary so that the excessive amount of the developer, inclusive of the waste carrier, in the developing device is discharged from the developing device and is recovered into the developer recovery container, due to the changes in the attitude of the developing device and developer recovery container relative to the direction of the gravitational force. This developer recovery method is advantageous in that the excessive amount of the developer in the developing device can be satisfactorily recovered without the provision of a complicated structural arrangement.

In this embodiment, the developing device 20 is provided with a developer supplying means 7 for supplying, at a predetermined rate, the developing means container 6 with the developer from the developer supply container. The developer supplying means 7 has a developer conveying member 7*a* in the form of a screw, for example, and is enabled to supply the developing means container 6 with carrier along with toner, at the rate proportional to the amount of toner consumed for development. The developer supply container may be made integral with the developer recovery container, being separated by a partitioning wall from the developer recovery chamber; the developer supply container and developer recovery container may be integrally molded.

After being supplied to the developing means container 6, the two-component developer is mixed into the body of the developer being circulated in the developing means container 6, while the excessive amount of the developer resulting from the addition of the fresh supply of two-component developer is recovered. As a result, the waste carrier is gradually recovered. The developer supply container will be described later.

Next, the developer recovery container 10 in this embodiment will be described.

In this embodiment, the developer recovery container 10 is mounted in the rotary developing apparatus 104 so that it is assured that as the rotary 30 rotates, the waste carrier is reliability recovered while being prevented from flowing backward. In other words, the waste carrier is recovered with the use of the simple structure which makes uses of the rotation of the rotary 30, reducing therefore the cost of the waste carrier recovery, hence, the image forming apparatus cost. In this embodiment, each of the developing devices 20Y-20Bk mounted in the rotary developing apparatus 104 is fitted with the developer recovery container 10.

The developer recovery container 10 is provided with a recovery opening 11, which is the entry opening through which the waste carrier 2 discharged from within the developing device 20 is received, and a recovered developer storage portion 10*a* for storing the developer received through the recovery opening 11. The developer recovery container 10 is also provided with a pipe-like member 12, as a conveyance pipe, which extends inward of the developer recovery container 10, virtually straight from the recovery opening 11. The pipe-like member 12 is provided with an opening 12*a*, as an outlet, which constitutes the end of the pipe-like member 12 opposite to the recovery opening 11. As the rotary is rotated, the excessive amount of the developer (waste carrier 2) received through the recovery opening 11 is conveyed through the pipe-like member 12, and is discharged into the recovered developer storage portion 10*a* through the opening 12*a*. Further, the developer recovery container 10 is structured so that it can be removed from the main assembly (rotary) of an image forming apparatus to be replaced, after it is filled with the waste carrier 2. Therefore, the developer recovery container 10 is provided with a shutter 13 for sealing the recovery opening 11. While the rotary is rotated, this shutter 13 is kept open to maintain a through passage between the developer outlet (outward opening of discharging pipe 21) of the developing device and the recovered developer storage portion 10*a* of the developer recovery container 10.

The developing device 20 has a discharge pipe 21 for discharging the waste carrier 2 into the developer recovery container 10. The positional relationship of this discharge pipe 21 is such that when the developer recovery container 10 is properly engaged with the developing device 20, the discharge pipe 21 aligns with the recovery opening 11 of the developer recovery container 10.

The developing device 20 and developer recovery container 10 are kept attached to each other by the engagement between the shutter 25 of the developing device 20 and the shutter 13 of the developer recovery container 10. More specifically, the shutters 13 and 25 of the developer recovery container 10 and developing device 20, respectively, remain shut until the developer recovery container 10 is properly engaged with the developing device 20. In order to open the shutters 13 and 25, the developer recovery container 10 must be set in the rotary so that the shutters 13 and 25 align with each other, and the knob 200 (FIG. 9), a rotational member, attached to the developer recovery container 10 must be rotated relative to the developer recovery container 10 after the developer recovery container 10 and the developing device 20 are properly anchored within the rotary. As the knob 200 is rotated, driving force is transmitted to the shutters 13 and 25 through a gear 26 as a driving force transmitting member on the image forming apparatus main assembly side (developing device 20 side). As a result, the both shutters 13 and 25 are opened to provide the through passage between the recovery opening 11 of the developer recovery container 10 and the discharge pipe 21 of the developing device 20, while keeping them aligned to each other. All that is necessary to close the shutters 13 and 25 is to reversely rotate the knob 200. As the knob 200 is reversely rotated, driving force is transmitted to both shutters 13 and 25 in the direction to close them. As a result, the above described openings of the developer recovery container 10 and developing device 20 are sealed.

Next, referring to FIG. 2 as well as FIG. 1, the process through which the waste carrier 2 is recovered from the developing device 20 into the developer recovery container 10 will be described.

Figure 2:
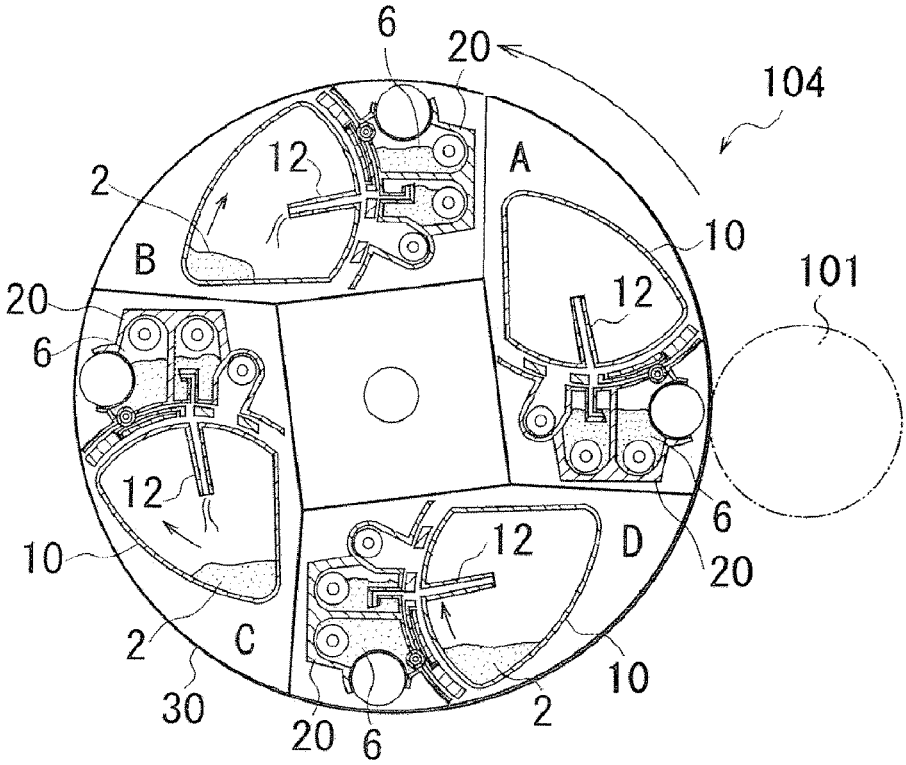
FIG. 2 is a schematic sectional view of an embodiment of a rotary developing apparatus, for describing the behavior of the waste carrier in the process in which the waste carrier is recovered into the developer recovery container, with the utilization of the rotation of the rotary of the rotary developing apparatus.

Referring to FIG. 2, the developing device position A in the rotary developing apparatus 104 is the development position. In this embodiment, the developer supplying means 7, stirring/conveying members 5*a* and 5*b*, development roller 3, etc., of the developing device 20 are enabled to function by becoming engaged with the driving means provided on the image forming apparatus main assembly side, only when the developing device 20 is almost exactly at the development position A. Also in this embodiment, when the developing device 20 is at the development position A, the developer recovery container 10 is virtually directly above the developing device 20.

As the amount of the developer in the developing device 20 is made excessive by the addition of the fresh supply of developer, the surplus developer (waste carrier 2) enters the discharge pipe 21 when the developing device 20 is at the development position A. Then, as the developer recovery container 10 and developing device 20 are brought to the positions B or C by the rotation (in arrow direction in FIG. 2 (counterclockwise direction)) of the rotary 30, the waste carrier 2 in the discharge pipe 21 falls, due to gravity, into the developer recovery container 10 through the recovery opening 11 and pipe-like member 12. In other words, the structural arrangement is such that the surplus developer in the developing device 20 can be discharged from the developing device 20, conveyed through the recovery opening 11 and pipe-like member 12, and recovered into the developer recovery container 10 by rotating the rotary approximately 180 degrees. In other words, this structural arrangement is better in recovery efficiency. Further, for the simplification of the structural arrangement, there is provided only one station (position or attitude in term of the rotational range of rotary) at which the developer recovery container can be mounted into, or removed from, the rotary. This station for the developer recovery container replacement may be set up at any location in the range between positions C and D. In other words, one half of the rotational range of the rotary made to have nothing to do with the recovery of the surplus developer, affording more latitude in image forming apparatus design.

The discharge pipe 21 within the developing device 20 is bent at a point 21*a*. More specifically, the discharge pipe 21 in this embodiment comprises a conveying portion 21*b* extending in such a direction that it will be vertical when the developing device 20 is at the development position A, and an exit portion 21*d*, which is approximately perpendicular to the conveying portion 21*b*, and the opening 21*c* of which faces toward the development roller 3. In other words, the discharge pipe 21 within the developing device 20 is bent approximately 90 degree at the point 21*a*. With the provision of this structural arrangement, a predetermined amount of waste carrier 2 can be recovery per full rotation of the rotary.

Figure 3:
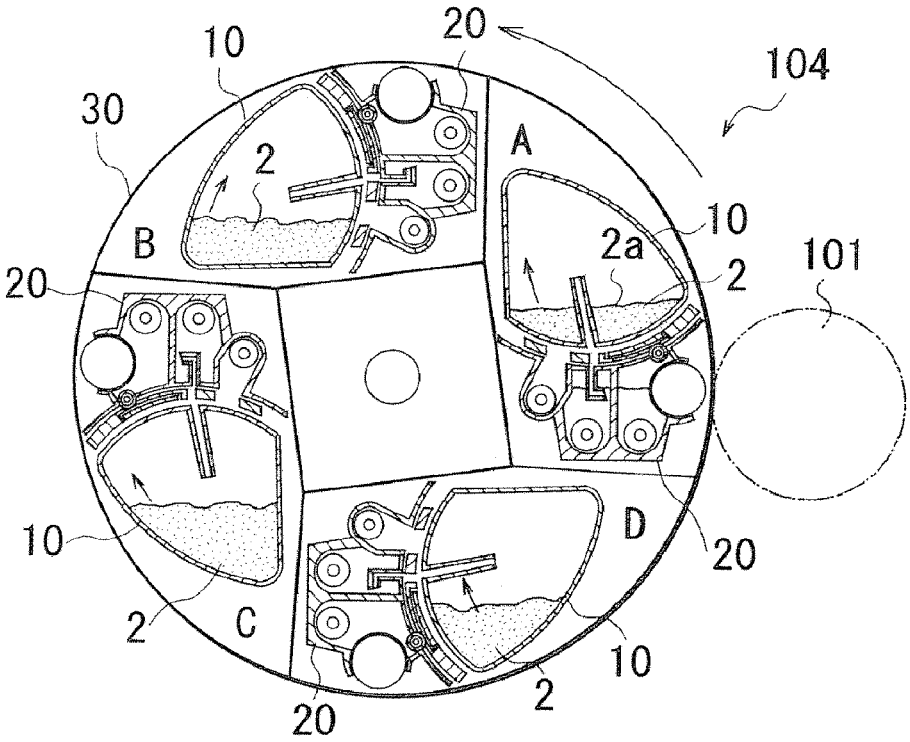
FIG. 3 is another schematic sectional view of the embodiment of the rotary developing apparatus, for describing the behavior of the waste carrier in the process in which the waste carrier is recovered into the developer recovery container, with the utilization of the rotation of the rotary of the rotary developing apparatus.

Next, the behavior of the waste carrier 2 within the developer recovery container 10 will be described in more detail. FIG. 3 shows the state of a certain amount of the waste carrier 2 having accumulated in the developer recovery container 10. In the drawing, the waste carrier 2 is represented by dots. The state of the waste carrier 2 varies as the rotary 30 is rotated. This states of the waste carrier 2 at the positions A-D are as shown in FIG. 3. As the rotary 30 is rotated, the waste carrier 2 in the developer recovery container 10 moves, relative to the developer recovery container 10, in the direction opposite to the rotational direction of the rotary, along the internal surface of the developer recovery container 10.

In order to prevent the waste carrier in the developer recovery container 10 from flowing back into the developing device while the waste carrier is moved in the developer recovery container by the rotation of the rotary 30, and also, to improve the waste carrier recovery efficiency, the developer recovery container 10 is structured so that the position of the discharge opening 12*a* of the pipe-like member 12 virtually coincides with the position of the center of gravity of the developer recovery container 10.

It is preferable that the opening 12*a* of the pipe-like member 12 faces in the direction different from the direction in which the developer enters the pipe-like member 12 through the recovery opening 11, for the following reason.

That is, even though the pipe-like member 12 is enabled to satisfactorily recover the waste carrier while preventing the waste carrier from flowing backward, the top surface of the body of the waste carrier 2 (body of developer particles) in the developer recovery container 10 does not always remain stable while the waste carrier 2 is moved along the internal surface of the developer recovery container 10 by the rotation of the rotary 30. In other words, there is the danger that the surface 2*a* of the body of the waste carrier 2 will sometimes rise above the opening 12*a* of the pipe-like member 12 in the developer recovery container 10, allowing the waste carrier 2 to be scooped up by the opening 12*a* portion of the pipe-like member 12 and flow back toward the developing device 20.

Figure 4:
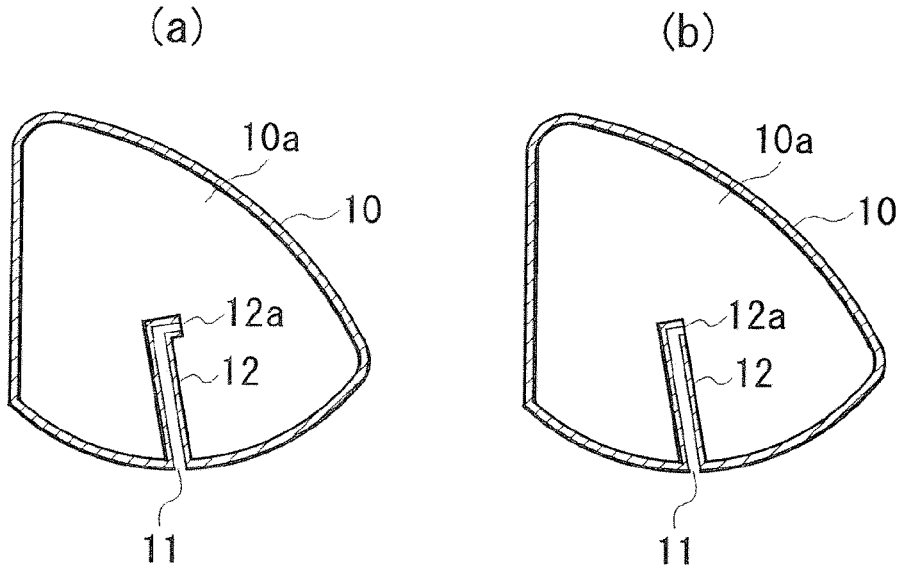
FIGS. 4*a* and 4*b* are schematic sectional views of another embodiment of a developer recovery container in accordance with the present invention.

In this case, it is desired that the inward end of the pipe-like member 12 is bent in the direction opposite to the rotational axis of the developer recovery container 10 so that the inward opening of the pipe-like member 12 faces opposite to the rotational axis of the developer recovery container 10 as shown in FIG. 4(*a*), or that the inward end of the pipe-like member 12 is provided with such an opening that faces opposite to the rotational axis of the developer recovery container 10 as shown in FIG. 4(*b*). The provision of the above described structural arrangement virtually eliminates the danger that the waste carrier 2 flows backward. Configuring the pipe-like member 12 so that the opening 12*a* cuts through the innermost end portion of the side wall of the pipe-like member 12 as shown in FIG. 4(*b*) makes it easier to manufacture the pipe-like member 12 by molding.

Figure 5:
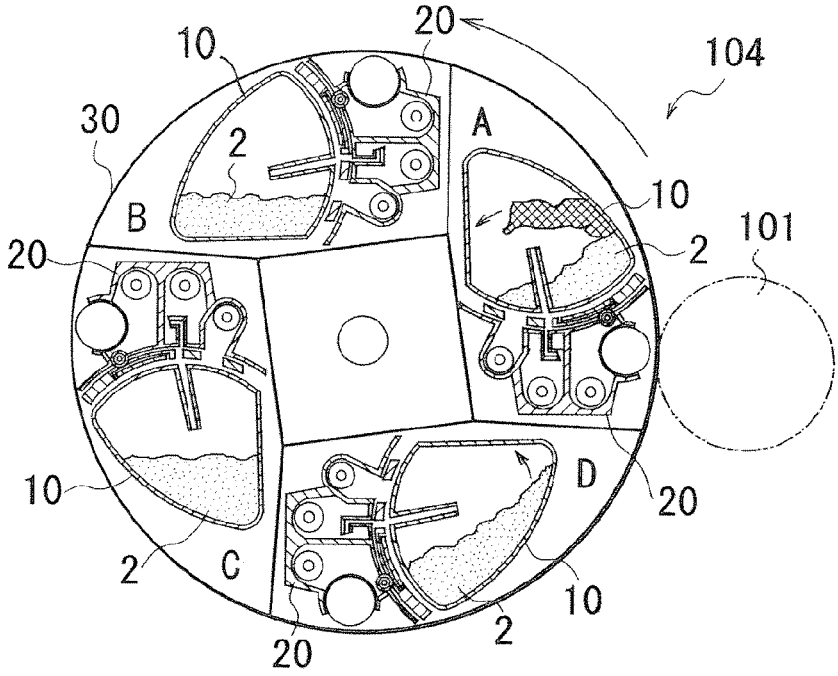
FIG. 5 is a schematic sectional view of another embodiment of a rotary developing apparatus, for describing the behavior of the waste carrier into the developer recovery container, which occurs as the rotary of the rotary developing apparatus is rotated.

The behavior of the waste carrier 2 in the developer recovery container 10 is affected by the type and physical properties of the waste carrier 2, the rotational condition of the rotary 30, etc. Thus, the centrifugal force generated by the rotation of the rotary 30 sometimes makes the waste carrier 2 fail to smoothly move along the inward surface of the developer recovery container 10 while the developing device 20 is moved from the position D to the position A by the rotation of the rotary 30 as shown in FIG. 5. In such a case, the waste carrier 2 sometimes moves above the opening 12*a* of the pipe-like member 12, in the manner indicated by an arrow mark in FIG. 5. This phenomenon occurs for the following reason: A part of the body of waste carrier 2 remains held to the internal surface of the developer recovery container 10 by the centrifugal force generated by the rotation of the rotary 30, and as the rotation of the rotary 30 is stopped, the part of the body of the waste carrier 2 remaining held to the internal surface of the developer recovery container 10 is ejected in the rotational direction of the rotary 30.

Figure 6:
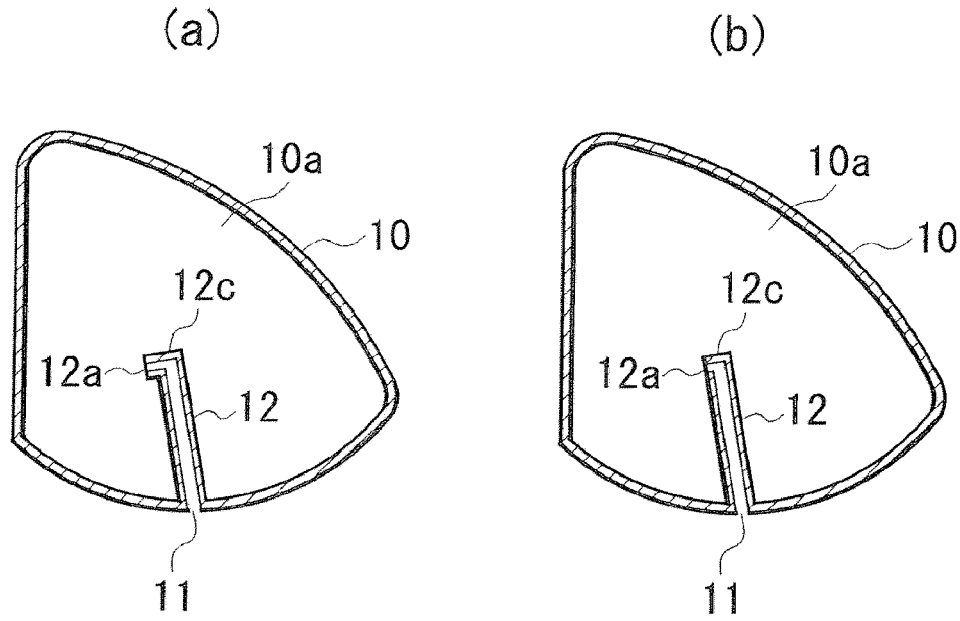
FIGS. 6*a* and 6*b* are schematic sectional views of another embodiment of a developer recovery container in accordance with the present invention.
Figure 7:
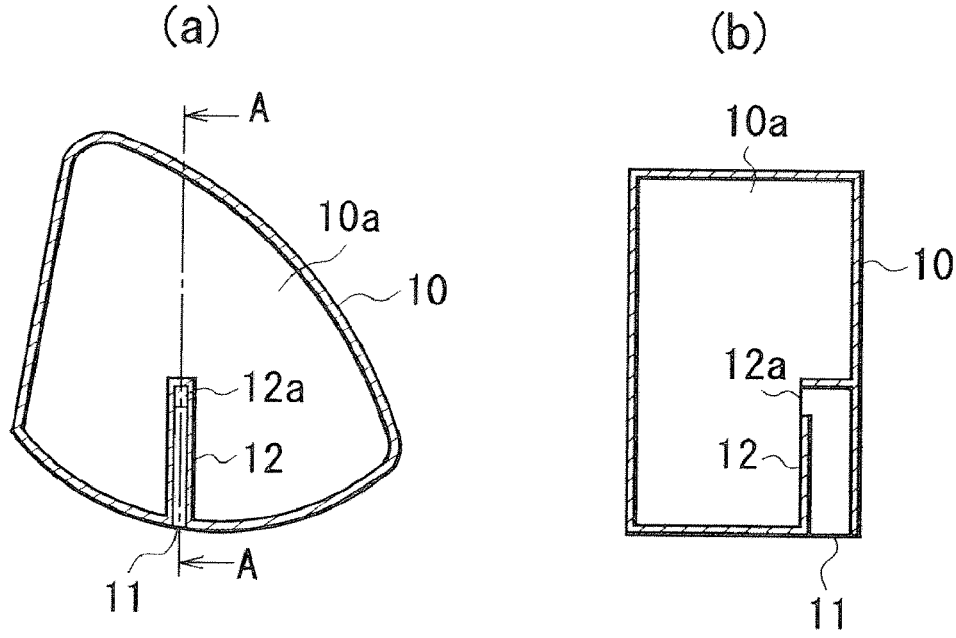
FIGS. 7*a* and 7*b* are schematic sectional views of another embodiment of a developer recovery container in accordance with the present invention, FIG. 7(*b*) being the cross section of the developer recovery container in FIG. 7(*a*), at the plane A-A in FIG. 7(*a*).

Thus, the pipe-like member 12 is desired to be configured so that the edge of its opening 12*a* becomes perpendicular to the advancing direction of the waste carrier 2, preferably, facing opposite to the advancing direction of the waste carrier 2, within the recovered developer storage portion 10*a* of the developer recovery container 10, as shown in FIGS. 6(*a*), 6(*b*) and FIGS. 7(*a*) and 7(*b*). In other words, it is desired that the pipe-like member 12 is configured so that the opening 12*a* faces downstream in terms of the rotational direction of the rotary 30. With the provision of the above described structural arrangement, the entry preventing portion 12*c* of the pipe-like member 12, shown in FIGS. 6(*a*) and 6(*b*), prevents the phenomenon that as the rotary is rotated, the waste carrier 2 enters the pipe-like member 12 through the opening 12*a* from the upstream side in terms of the rotational direction of the rotary and flows back into the developing device.

The pipe-like member 12 shown in FIG. 6(*a*) is configured so that its innermost end portion is bent toward the rotational axis, whereas the pipe-like member 12 shown in FIG. 6(*b*) is configured so that the opening 12*a* faces toward the rotational axis. In other words, both pipe-like members 12 are configured so that their openings face downstream in terms of the moving direction of the developer in the recovered developer storage portion 10*a* of the developer recovery container 10. Configuring the pipe-like member 12 so that the opening 12*a* is at the innermost end portion of the side wall of the pipe-like member 12 as shown in FIG. 6(*b*) makes it easier to form the pipe-like member 12 by molding.

The pipe-like member 12 shown in FIGS. 7(*a*) and 7(*b*) is configured so that its opening 12*a* faces in the direction parallel to the rotational axis of the developer recovery container 10, that is, the lengthwise direction of the developing device 20. This pipe-like member 12 may be configured so that its innermost end portion is bent in the direction parallel to the axial line (lengthwise direction) of the developer recovery container 10. Configuring the developer recovery container 10 so that a part of the wall of the recovered developer storage portion 10*a* doubles as one of the walls of the pipe-like member 12 as shown in FIG. 7(*b*) makes it possible to reduce the cost of the developer recovery container 10 by simplifying the structure of the mold for the developer recovery container 10.

As described above, configuring the pipe-like member 12 so that the opening 12*a* of the pipe-like member 12, that is, the opening opposite to the receiving opening 11 of the pipe-like member 12, faces in the optimal direction further assures that the waste carrier 2 is prevented from flowing backward through the opening 12*a* of the pipe-like member 12. Also as described above, the rotation or stopping of the rotary developing apparatus 104 sometimes ejects some of the recovered developer into the air in the developer recovery container 100, in such a manner that the ejected developer flies past the opening 12*a* of the pipe-like member 12. Configuring the pipe-like member 12 as shown in FIG. 6 or 7 assures that the developer is prevented from flowing backward through the opening 12*a* in a situation such as the one described above.

Further, the pipe-like member 12 is desired to be structured so that its internal diameter gradually reduces starting from the recovery opening 11 toward the opposite opening, that is, the opening 12*a*. In other words, it is desired that the cross section of the outlet opening 21*e* of the discharge pipe 21 is made smaller than that of the recovery opening 11 of the recovery container to effectively prevent the developer from leaking at the junction between the developing device and developer recovery container. Thus, the recovery opening has to be made relatively large. However, from the standpoint of backflow prevention, it is preferable that the opening 12*a* of the recovery container is smaller in internal diameter than the recovery opening 11. With the opening 12 being smaller in internal diameter, it is more difficult fro the recovered developer to flow backward.

Further, in consideration of the moldability of the developer recovery container 10, it is desired that the pipe-like member 12 extends straight from the recovery opening 11 toward the recovered developer storage portion 10*a*, and that the pipe-like member 12 extends from the recovery opening 11 toward the center of gravity of the recovered developer storage portion 10*a*. Configuring the developer recovery container 10 in this manner makes it possible to accomplish cost reduction by simplifying the structures of the molds for the developer recovery container 10.

Further, the cost of the developer recovery container 10 can be reduced by forming the pipe-like member 12 as an integral part of the recovered developer storage portion 10*a*.

As for the specifications of the rotary 30, it is desired that the moving time is no less than 0.1 second and no more than 0.1 second, and also, that the peripheral velocity is no less than 0.1 m/sec and no more than 2 m/sec. Herein, the peripheral velocity of the rotary 30 means the velocity of such a point of the rotary 30 that corresponds to the maximum radius of the rotary developing apparatus 104 holding the developer recovery containers 10. The longer the moving time of the rotary 30, or the slower the peripheral velocity of the rotary 30, the slower the image formation speed, and therefore, the lower the image formation productivity. In other words, it is possible that a moving time of the rotary 30 longer than a certain value, or a peripheral velocity of the rotary 30 slower than a certain value, will adversely affect the usability of an image forming apparatus. On the other hand, it is possible that if the moving time of the rotary 30 is shorter than a certain value, or the peripheral velocity of the rotary 30 is faster than a certain value, force of gravity will fail to make all the waste carrier scooped up by the discharge pipe 21, fall all the way through the pipe-like member 12, allowing some of the waste carrier to flow backward.

As for the size of the rotary 30, the radius of the rotary 30 is desired to be no less than 50 mm and no more than 300 mm. If it is no more than 50 mm, it is difficult to mount the plurality of developing devices 20 in the rotary 30. On the other hand, if it is no less than 300 mm, the image forming apparatus main assembly must be increased in size, against the trend which favors size reduction. Therefore, it is not desired that the radius of the rotary 30 is no more than 300 mm.

Heretofore, the developer recovery container 10 was described. The developer recovery container 10 may be formed as a discrete member, as shown in FIG. 7(*b*), which is removably attached to the developing device 20, or may be integrally formed with the developer supply container.

When integrally forming the developer recovery container 10 with the developer supply container for storing the developer supplied to the developing device 20, it is desired, although not mandatory, that the developer recovery container 10 and developer supply container are identical in cross section. The pipe-like member 12 in accordance with the present invention is very simple in structure. Therefore, even if the developer recovery container 10 has to be made complicated in cross section because of the image forming apparatus main assembly, countermeasures can be easily worked out with the employment of the pipe-like member 12 in accordance the present invention.

Also when integrally forming the developer recovery container 10 with the developer supply container, the partitioning wall between the developer recovery container and developer supply container may be made parallel to the lengthwise direction of the developer recovery container 10, so that the developer is supplied to the developing device 20 from the thus formed developer supply container. However, the direction in which the partition wall between the developer recovery container and developer supply container is extended does not need to be limited to the lengthwise direction of the two containers. Further, the type of the developer delivery method of the developer supply container 1 does not matter. In consideration of the fact that the developer supply container is mounted in the rotary 30 along with the developer recovery container 10, it is desired to employ such a developer delivery method that utilizes the rotation of the rotary 30, that is, the orbital movement of the developer supply container, more specifically, takes advantage of the changes in the attitudes of the developer supply container and developing device 20 relative to the direction of the force of gravity, in order to deliver the developer within the developer supply container to the developing device 20, because such a method requires only a simple structural arrangement for the developer delivery.

Integrally forming the developer recovery container 10 and developer supply container 1, and utilizing the change in the attitude of the two containers relative to the direction of gravitational force, make it possible to simplify the toner delivery operation as well as waste carrier recovery operation while improving the efficiency with which one or both of the two containers are replaced.

Figure 8:
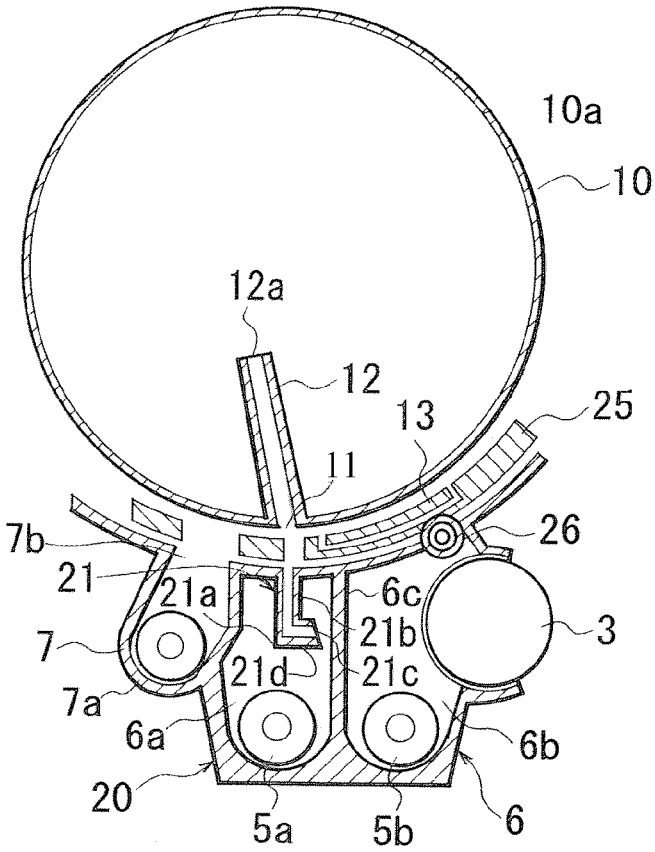
FIG. 8 is a schematic sectional view of a combination of another embodiment of a developer recovery container in accordance with the present invention, and a developing device.
Figure 9:
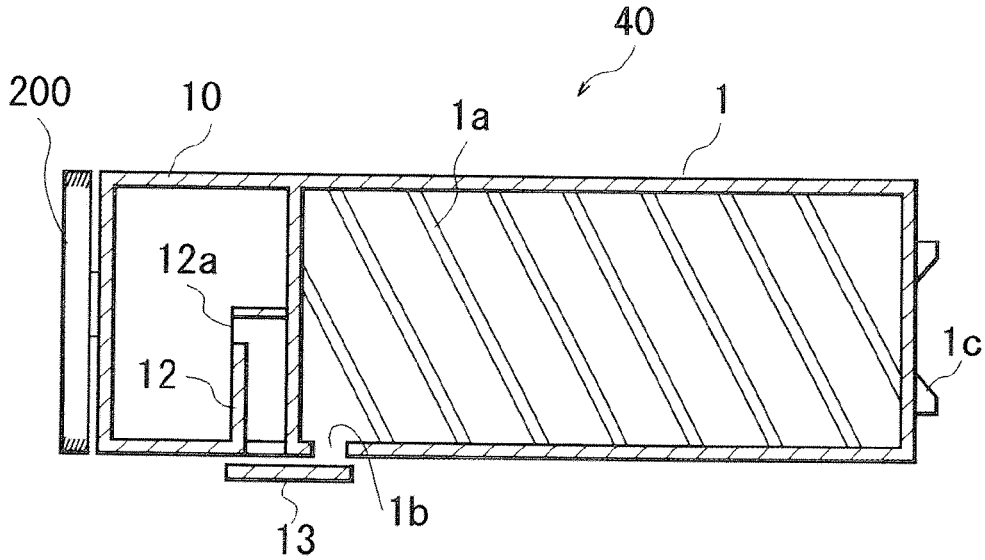
FIG. 9 is a schematic sectional view of another embodiment of a developer recovery container in accordance with the present invention.

FIG. 8 is a schematic sectional view of an example of a combination of a cartridge 40 comprising an integral combination of the developer recovery container 10 and developer supply container 1, and the developing device 20. FIG. 9 is a schematic sectional view of the cartridge 40, parallel to the lengthwise direction of the cartridge. In FIGS. 8 and 9, the elements similar in function to those of the developer recovery container 10 and developing device 20 shown in FIG. 1 are given the same referential signs as the referential signs given to those of the developer recovery container 10 and developing device 20 shown in FIG. 1, and these elements will be not described in detail.

Referring to FIG. 8, the developer supply container 1 and developer recovery container 10 in this embodiment are cylindrical, being virtually circular in cross section. The developer recovery container 10 is provided with the pipe-like member 12 described above. The developer supply container 1 is provided with a delivery opening 1*b*, that is, the opening through which the developer is supplied to the developing device 20. When the cartridge 40 is not attached to the developing device 20, this delivery opening 1*b* is kept sealed by the shutter 13 with which the developer recovery container 10 is provided. As the cartridge 40 is properly mounted into the developing device 20, the shutter 13 moves in the same manner as does the shutter 13 shown in FIG. 1, exposing the delivery opening 1*b*. In other words, the developing apparatus 20 and cartridge 40 are structured so that the shutter 13 of the developer recovery container 10 seals, or exposes, both the recovery opening of the developer recovery container 10 and the delivery opening 1*b* of the toner supply container 1. The mechanism for opening or closing this shutter 13 is the same as that described before.

The developer supply container 1 is provided with a helical rib 1*a*, as a conveying means for conveying the developer toward the delivery opening 1*b*, which is in the internal surface of the cylindrical portion of the developer supply container 1. As the rotary 30 is rotated, the developer supply container 1 is orbitally moved about the rotational axis of the rotary 30. As a result, the developer supply in the developer supply container 1 is guided toward the delivery opening 1*b* by the helical rib 1*a*.

In comparison, the developing device 20 is provided with a developer supplying means 7 for supply the developer supplied from the developer supply container 1, to the developing means container 6, at a predetermined rate. The developer supplying means 7 is provided with a developer supply reception opening 7*b* connected to the delivery opening 1*b* of the developer supply container 1. After being conveyed to the delivery opening 1*b* of the developer supply container 1, the developer is supplied by force of gravity to the developer supplying means 7 through the developer supply reception opening 7*b*

The developer supplying means 7 has a conveying screw 7*a* as a developer conveying means, by which the developer is conveyed to be supplied to the developing means container 6 through the developer supply reception opening (unshown), at a predetermined rate.

There is no limitation to the method for conveying the developer within developer supply container 1. For example, it may be a method, for example, in which the developer is supplied to the developer supply container 1 by a conveying member (for example, screw) disposed within the developer supply container 1 and driven by the driving force transmitted from the image forming apparatus main assembly through a driving force receiving portion 1*c*. In other words, as long as the developer can be satisfactorily supplied, the structure of the developer supply container 1 does not matter.

In FIGS. 8 and 9, the developer supply container 1 and developer recovery container 10 are both virtually circular in cross section. However, the developer supply container 1 and developer recovery container 10 may be noncircular in cross section. Even if the developer supply container 1 and developer recovery container 10 are complicated in cross section because of the image forming apparatus main assembly, the developer recovery container 10 can be provided with the pipe-like member 12, regardless of their shapes. Therefore, the developer recovery container 10 can be formed as an integral part of the developer supply container 1 while remaining simple in structure, making it possible to reduce the cost of the developer recovery container 10. Further, a larger amount of the waste carrier can be stored. Therefore, the developer recovery container 10 can be shorter in term of its lengthwise direction, provided that the cross section remains the same. Therefore, it is possible to increase the internal volume of the developer supply container 10; a larger amount of developer can be stored. Further, the waste carrier can be easily removed, improving the operability and operational efficiency of an image forming apparatus.

As described above, according to the above described embodiment of the present invention, not only can the back-flow of the waste carrier be prevented, but also, a larger amount of the waste carrier can be stored for recovery, by the simple structural arrangement of providing the developer recovery container 10 with the pipe-like member 12 as the waste carrier recovering means. The pipe-like member 12 is extremely simple in structure. In other words, unlike the prior art, this embodiment does not require a large and complicated recovery mechanism, making it possible to provide an inexpensive developer recovery container 11. The effectiveness of the structural arrangement for the developer recovery container 10 in this embodiment does not rely on the shape of the cross section of the developer recovery container 10, affording greater latitude in designing the developer recovery container 10, and also, making it possible to store more recovered waste carrier.

The preceding embodiments of the present invention were described with reference to the rotary developing apparatus 104, in which the four developing devices 20Y-20Bk, and the four developer recovery containers 10Y-10Bk were mounted, and which stopped at four different angular positions. However, the present invention is also applicable to, for example, an image forming apparatus in which the black color component developing device 20B is disposed independent from (outside of) the rotary 30; three developing devices (for yellow, magenta, and cyan, for example) and three developer recovery containers are mounted in the rotary developing apparatus 104; and the rotary stops at three angular positions, and such an application produces the same effects as the above described ones.

Figure 11:
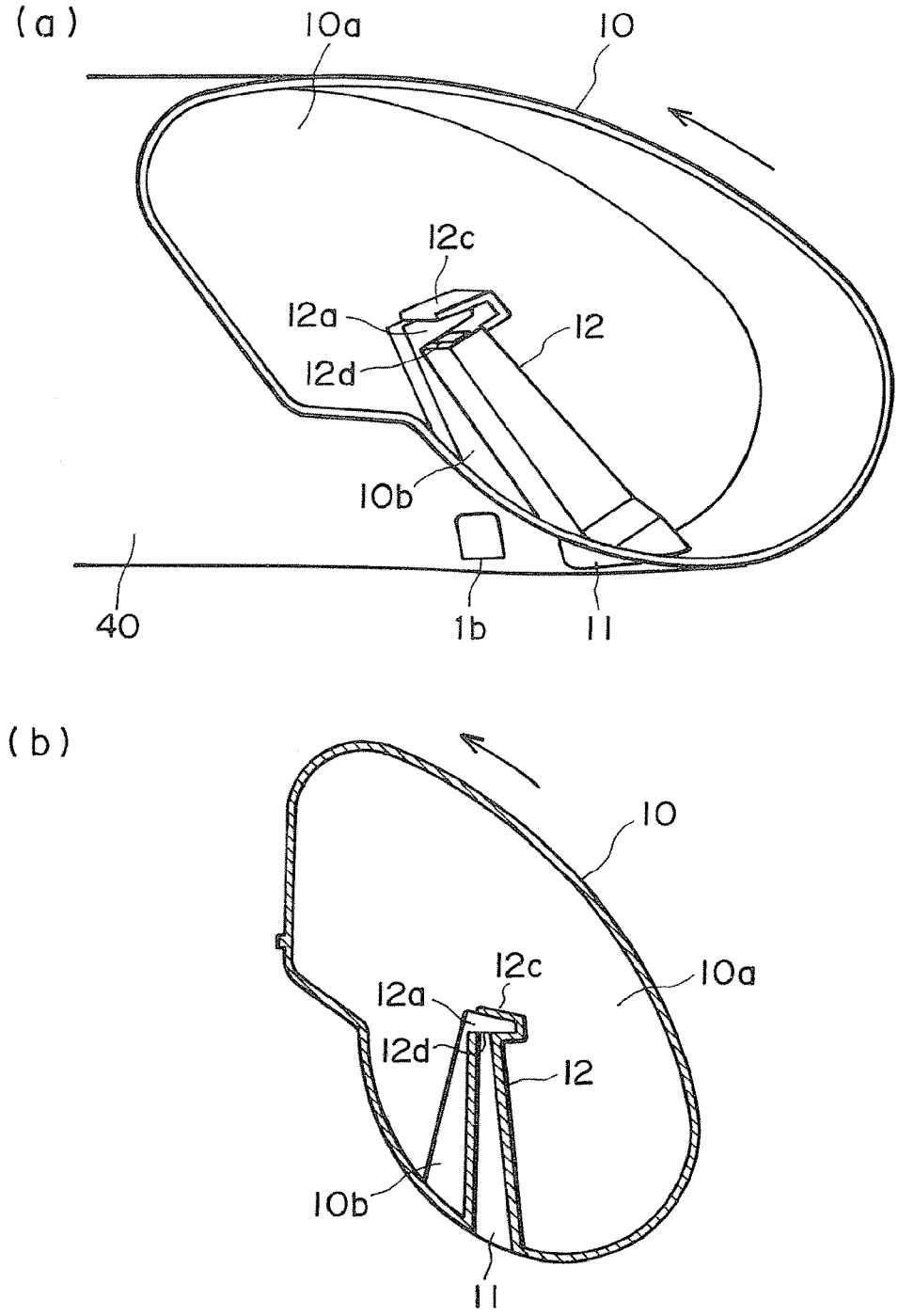
FIG. 11(*a*) is a schematic perspective view of another embodiment of a developer recovery container to which the present invention is applicable, and FIG. 11(*b*) is a schematic sectional view of the developer recovery container in FIG. 11(*a*).

FIGS. 11(*a*) and 11(*b*) show the cartridge 40, which is an integral combination of the developer recovery container 10 and developer supply container 1. The developer recovery container 10 shown in FIG. 11 is slightly different in the structure of the pipe-like member from those in the preceding embodiments. More specifically, the pipe-like member 12 in this embodiment is disposed on a mound (bulging from developer supply container side toward developer recovery container side, being hollow on the developer supply container side, and therefore, increasing storage capacity of developer supply container) formed as a part of the partitioning wall which separates the developer recovery container 10 from the developer supply container 1. With the provision of this structural arrangement, it is difficult for the recovered developer to enter the pipe-like member 12 through the opening 12*a* (which faces downstream in terms of rotational direction of rotary, and is located close to approximate center of gravity of recovery container). Further, the pipe-like member 12 is provided with an entry prevention portion 12*c*, which is positioned in a manner to oppose the exit opening 12*d*, preventing the developer from entering the pipe-like member 12 from upstream in terms of the rotational direction of the rotary. This entry prevention portion 12*c* is structured so that it does not interfere with the discharging of the developer from the opening 12*a* in the downstream direction in terms of the rotational direction of the rotary.

Further, the developer supply container 1 is provided with a developer delivery opening 1*b*, which is located next to the hollow portion. The employment of this structural arrangement makes it possible to place the developer delivery opening of the developer supply container and the recovery opening of the developer recovery container close to each other, making it possible, thereby, to minimize the size of the shutter 13 employed by the aforementioned structure which uses the shutter 13 as a common shutter for sealing or exposing both openings.

The entry prevention portion 12*c* is structured so that its surface opposite the delivery opening 12*d* is inclined relative to the edge of the delivery opening 12*d* (FIG. 11(*b*)). In other words, it is structured so that the developer, which is made to come out of the recovery developer delivery opening 12*d* (smaller than recovery developer entry opening 11) by the rotation of the rotary after it is conveyed through the pipe-like member by the rotation of the rotary, bumps into the entry prevent portion 12*c*, and slides down on the surface of the entry prevention portion 12*c* opposite to the delivery opening 12*d*, into the recovery container due its own weight.

The other aspects of the structure of the developer recovery container in this embodiment are the same as those in the preceding embodiments described above.

In this embodiment, the developer supply container 1 is provided with a stirring member, which is disposed within the developer supply container 1. The stirring member comprises a rotational shaft and a plurality of flexible blades fixed to the rotational shaft. The blades are tilted at their tips at such an angle that as the stirring member is rotated, the developer in the developer supply container 1 is conveyed, while being stirred, by the stirring member toward the exit opening, and is discharged from the exit opening by the stirring member.

A developer supply/recovery kit is prepared by filling up the developer supply container portion of the cartridge (4) with a developer, which is concocted by mixing well a 540 g of particulate toner, and 95.03 g of particulate magnetic carrier, that is, particulate resin in which magnetic particles have been uniformly dispersed. In comparison, the developing devices in the rotary developing apparatus are filled with a developer, which was concocted by mixing well 18.4 g of particulate two-component toner, and 211.6 g of particulate magnetic carrier, that is, particulate resin uniformly containing magnetic particles. The magnetic particle dispersion type resinous carrier used in this embodiment was 3.8 in absolute specific gravity, and 1.8 in apparent specific gravity.

The absolute specific gravity of the magnetic carrier in the developer supply container is desired to be no less than 2.5 and no more than 4.5. When such a carrier as the one described above is employed, the developer recovery container filled with the recovered developer is lighter, being smaller in the work load taxed an operator when removing a cartridge, the service life of which has expired, in order to process it.

In the case of a cartridge design in which a developer recovery container is attached to one of the lengthwise ends of a developer supply container, the weight of the recovered developer in the developer recovery container makes the rotary developing apparatus lopsided in weight distribution, affecting the inertial impact, in particular, when the rotary of the rotary developing apparatus comes to a stop. Therefore, such problems as the production of blurred images occur. Thus, it is advantageous to employ a carrier such as the carrier employed in this embodiment which is smaller in specific gravity.

To described in more detail, it is desired that the volume average particle diameter of the resinous carrier is in the range of 25-55 μm, and that the amount of the particles no more than 21 μm in volume average particle diameter is in the range of 0.01 to 12 in mass percentage; the amount of the particles no more than 15 μm in volume average particle diameter is no more than 3.0 in mass percentage; the amount of the particles no less than 50 μm in volume average particle diameter is in the range of 0.1 to 20 in mass percentage; and the amount of the particles no less than 72 μm in volume average particle diameter is no more than 1.0 in mass percentage.

The resinous carrier is particulate carrier formed of resin (binder) in which inorganic chemical compound was uniformly dispersed. The resinous carrier particles are desired to be processed on their surfaces.

All that is required of the inorganic chemical compound particles used as one of the essential components of the resinous carrier is that they do not dissolve in water, or that they are not deteriorated, or denatured, by water. As for such substances, it is possible to list magnetic inorganic chemical compound particles, or a mixture of magnetic inorganic chemical compound particles and nonmagnetic inorganic chemical compound particles.

Examples of the magnetic inorganic chemical compound particles usable as the material for the resinous carrier in accordance with the present invention are magnetite particles, maghemite particles, magnetite particles coated with cobalt or containing cobalt, maghemite particles coated with or containing cobalt, magneto plumbite type ferrite particles containing barium, spinel type ferrite particles containing one, or two or more, among strontium, or barium-strontium, manganese, zinc, lithium, magnesium, etc., and the like.

As for the nonmagnetic inorganic chemical compound particles, hematite particles, hydrous ferric oxide particles, titanium oxide particles, silica particles, talc particles, alumina particles, barium sulfate particles, barium carbonate particles, cadmium yellow particles, calcium carbonate particles, zinc white particles, etc., can be used.

For the purpose of adjusting the magnetic force of the carrier to prevent carrier adhesion, and for adjusting the volume resistance value of the carrier, it is desired that magnetic inorganic chemical compound particles are contained in the carrier by 30-95% in mass relative to the sum of the magnetic inorganic chemical compound particles and nonmagnetic inorganic chemical compound particles.

As the binder resin which constitutes the carrier core, thermosetting resins are particularly desirable.

As examples of the thermosetting resins suitable as the material for the binder resin for the carrier, phenol resin, epoxy resin, polyamide resin, melamine resin, urea resin, unsaturated polyester resin, alkyd resin, xylene resin, acetoguanamine resin, fran resin, silicone resin, polyimide resin, urethane resin, etc., are usable. These resins may used alone or in the combination of two or more. However, it is desired that at least phenol resin is included.

If necessary, magnetic carrier particles may be coated with coupler or resin, on their surfaces.

The above described kits and developing devices were mounted in the rotary developing apparatus, and a predetermined image forming process was repeatedly carried out. The developers were supplied by the stirring members from the developer supply containers to the developing devices. Since the developer contains carrier as well as toner, the amount of the carrier in the developing device gradually became excessive. As a result, the developer containing toner as well as carrier is discharged (allowed to overflow). The discharged developer entered to the pipe-like members through the entry opening of the cartridge, moved through the pipe-like members, and is recovered into the developer recovery containers.

By the end of the production of approximately 20,000 prints, virtually the entirety of the developer in the developer supply container were discharged, and 106 g of developer was recovered into the developer recovery container. The analysis of this recovered developer revealed that it contained 9 g of toner and 97 g of carrier, being virtually the same in composition as the developer in the developing device. In other words, the carrier in the developing device was replaced little by little by the fresh supply of carrier, while keeping the amount of the supplied carrier and the amount of the recovered carrier virtually equal. Therefore, the ratio of the carrier and toner in the developing device was kept approximately constant. As a result, image density remained constant from the beginning to end of the image formation test. The adhesion of developer to the internal surface of the pipe-like member was insignificant; the developer was smoothly recovered.

As is evident from the above description of the embodiments of the present invention, according to the present invention, deteriorated developer can be reliably recovered with the employment of the simple structural arrangement, without allowing the deteriorated developer to flow backward. Also, according to the present invention, the deteriorated developer can be recovered with the employment of a simple structural arrangement, regardless of the cross section of a developer recovery container, making it possible to reduce the cost of the developer recovery container. In addition, the deteriorated developer can be recovered while most efficiently using the developer recovery container capacity. Therefore, it is unnecessary to provide a developer recovery container with an excessive capacity to ensure that there will be sufficient storage capacity for the deteriorated developer. Therefore, it is possible to reduce the developer recovery container size, hence, the image forming apparatus main assembly size.

Further, according to the present invention, a mixture of two-component toner and magnetic particle dispersion type resinous carrier is used as developer. Therefore, the waste developer is lighter, reducing therefore the work load taxing an operator during the replacement of a developer recovery container, and also, reducing the impact upon a rotary developing apparatus as the rotary developing apparatus. Therefore, the amount by which the recovered developer is ejected into the air in the developer recovery container is smaller. Thus, the recovered developer does not flow backward. In other words, not only is the present invention is very effective to prevent the backflow of the recovered developer, but also to prevent the production of defective images such as a blurred image.

Moreover, the magnetic particle dispersion type resinous carrier in accordance with the present invention is smaller in specific gravity, and also, sharper in particle size distribution. Therefore, it is not likely to segregate when remaining mixed with toner. Therefore, it can be reliably discharged from the developer supply container. Further, the magnetic particle dispersion type resinous carrier in accordance with the present invention is particularly smaller in the amount of microscopic particles it contains. Therefore, it is smaller in the amount of the particles which adheres to the internal surface of a container or the internal surface of a pipe. Therefore, it is capable of passing through a narrow path such as the passage in the above described pipe-like member, causing no problem while it is recovered.

While the invention has been described with reference to the structures disclosed herein, it is not confined to the details set forth, and this application is intended to cover such modifications or changes as may come with in the purposes of the improvements or the scope of the following claims.

What is claimed is:

1. A developer collecting container detachably mountable to a rotatable member which is provided in an image forming apparatus to rotate a developing device, said developer collecting container which is rotatable while being substantially fixed to said rotatable member with said developing device, said developer collecting container comprising:

a receiving port for receiving a developer discharged from the developing device;

an accommodating portion for accommodating the developer collected from the developing device;

a guiding pipe, having a discharge opening for permitting discharging of the developer into said accommodating portion, for guiding the developer received at said receiving port with rotation of the rotatable member to said discharge opening;

a suppressing portion, provided adjacent said discharge opening in said accommodating portion, for suppressing entrance of the developer from said accommodating portion into said guiding pipe through said discharge opening by rotation of said rotatable member;

wherein said guiding pipe extends substantially rectilinearly from said receiving port in a rotational direction of said rotatable member, wherein said suppressing portion including, a portion, provided at a position adjacent of said discharge opening, for limiting movement of the developer toward said discharge opening.

2. A container according to claim 1, wherein said suppressing portion includes a surface for being abutted by the developer discharged through said discharge opening with rotation of said rotatable member to promote moving of the developer into said accommodating portion by gravity.

3. A container according claim 1, wherein said discharge opening has a size smaller than said receiving portion.

4. A container according to claim 3, wherein said developer collecting container is set on said rotatable member such that the receiving port is in fluid communication with a developer discharge opening of said developing device having a size smaller than said receiving port, and the fluid communication between said receiving port and the developer discharge opening of said developing device is maintained during rotation of said rotatable member.

5. A container according to claim 1, wherein said guiding pipe is projected substantially linearly from said receiving port toward inside of said accommodating portion.

6. A container according to claim 1, wherein said developer collecting container is integral with a developer supply container accommodating a developer to be supplied to the developing device.

7. A container according to claim 6, wherein the developer in said developer supply container is a mixture including non magnetic toner particles and magnetic carrier particles having a true specific gravity of not less than 2.5 and not more than 4.5, and said developer collecting container collects a mixture containing the non magnetic toner and magnetic carrier particles from the developing device.

8. A container according to claim 1, wherein said developer collecting container is set on said rotatable member such that the receiving port is in fluid communication with a developer discharge opening of said developing device having a size smaller than said receiving port, and the fluid communication between said receiving port and the developer discharge opening of said developing device is maintained during rotation of said rotatable member.

9. A container according to claim 1, wherein said accommodating portion and said guiding pipe are integral with each other.

* * * * *